US005736216A

United States Patent [19]

Shibahara et al.

[11] Patent Number: 5,736,216

[45] Date of Patent: Apr. 7, 1998

[54] FASTENER HAVING HIGH SILENCING PROPERTY

[75] Inventors: Norihito Shibahara, Hachioji; Hiroaki Takahashi, Sagamihara; Osamu Sawajiri, Sagamihara; Shinji Torigoe, Sagamihara, all of Japan

[73] Assignee: Minnesota Mining and Manufacturing Company, St. Paul, Minn.

[21] Appl. No.: 702,619

[22] PCT Filed: Apr. 6, 1995

[86] PCT No.: PCT/US95/04265

§ 371 Date: Aug. 30, 1996

§ 102(e) Date: Aug. 30, 1996

[87] PCT Pub. No.: WO95/27418

PCT Pub. Date: Oct. 19, 1995

[30] Foreign Application Priority Data

Apr. 12, 1994 [JP] Japan ..... 6-073340

[51] Int. Cl.$^6$ ..... A44B 18/00

[52] U.S. Cl. ..... 428/99; 428/100; 24/451

[58] Field of Search ..... 428/99, 100; 24/451

[56] References Cited

U.S. PATENT DOCUMENTS

| | | | |
|---|---|---|---|
| 4,198,734 | 4/1980 | Brumlik | 24/541 |
| 4,290,174 | 9/1981 | Kalleberg | 24/204 |
| 4,290,832 | 9/1981 | Kalleberg | 156/72 |
| 4,894,060 | 1/1990 | Nestegard | 604/391 |
| 5,077,870 | 1/1992 | Melbye et al. | 24/452 |
| 5,242,646 | 9/1993 | Torigoe et al. | 264/219 |

FOREIGN PATENT DOCUMENTS

| | | |
|---|---|---|
| 36248 | 3/1980 | Japan . |
| 2-66365 | 3/1990 | Japan . |
| 4-224856 | 8/1992 | Japan . |
| 5-192939 | 8/1993 | Japan . |

*Primary Examiner*—Alexander Thomas

*Attorney, Agent, or Firm*—Scott A. Bardell; Harold C. Knecht, III

[57] ABSTRACT

The present invention provides a fastener which does not generate noise when it is engaged to an article and vibration is applied thereto.

The fastener comprises a base portion, a stem portion implanted and interconnected to the base portion in a spaced-apart relationship by a predetermined distance from the base portion, and a head portion interconnected to the distal end of the base portion. At least a part of the stem portion or the head portion comprises (1) a polyphase polymer material having a first polymer resin and a second polymer resin, or (2) a polymer resin that increases the flexural modulus of the fastener.

Since the fastener does not generate noise during vibration, it is useful as a fastener particularly for fitting automobile components together.

21 Claims, No Drawings

FASTENER HAVING HIGH SILENCING PROPERTY

DETAILED DESCRIPTION OF THE INVENTION

1. Field of Utilization in Industry

This invention relates to a face fastener having a high silencing property.

2. Background

Fasteners have been used as plastic components in industrial fields, particularly in the automobile industry. Recently, silence has become one of the important factors for the improvement of automobile quality, and reduction or suppression of offensive noise, such as creak noise resulting from the movement of engaged fasteners, has been desired earnestly.

Japanese Unexamined Patent Publication (Kokai) Nos. 4-224856 and 2-66365 disclose a low noise gear resin prepared by blending polyethylene wax and silicone oil to a polyacetal resin. Though the polyacetal resin has high mechanical strength, it has low toughness, a high specific gravity and a high cost of production. Another problem is that when the polyacetal resin is used in an engaged face fastener, it is easily broken from its stem portion. When a low molecular weight compound such as polyethylene wax or silicone oil is added, a silencing effect can be temporarily obtained, it is true, but the effect does not last for a long time because the compound falls off from the surface.

Japanese Unexamined Patent Publication (Kokai) No. 5-192939 discloses an engaged face fastener comprising nylon, polypropylene, polyacetal, or the like. Although such an engaged face fastener has various advantages such as easiness of production and a high engagement strength, it is not free from the drawback in that when it is used for the application where vibration is applied to the face fastener, such as fixing members of interior decoration materials of automobiles, it generates offensive noise. Nylon, for example, has high hygroscopicity and when it absorbs moisture, its mechanical strength drops and causes so-called "shake", so that offensive noise is likely to occur. Polypropylene has low heat resistance and low wear resistance and its mechanical strength is likely to drop during use. Accordingly, noise and creak are likely to occur.

SUMMARY OF THE INVENTION

The present invention provides a fastener which has high mechanical strength and high durability, and can be produced easily. Moreover, the fastener of the invention does not generate noise when engaged with a second component and vibration is applied thereto.

The advantages of the present invention are achieved by the use of fastener having a high silencing property. In one embodiment, the fastener of the invention comprises a base portion, a stem portion implanted and interconnected to the base portion in a spaced-apart relationship by a predetermined distance from the base portion, and a head portion interconnected to the distal end of the base portion. When the fastener is engaged, the sliding resistance of the fastener is reduced with respect to a relative moving operation of the engaged face fastener.

Preferably, the sliding resistance is reduced by using, as at least a part of the stem portion or the head portion, a polyphase polymer material comprising a first polymer resin and a second polymer resin containing at least a fluorocarbon resin or an ultra-high molecular weight polyethylene resin.

As used herein, the term "polyphase" that the two polymers form a sea-island like phase-separated structure, and more preferably, the first polymer forms a continuous phase (sea) and the second polymer forms a discontinuous phase (islands). The islands preferably have a size of from 0.01 to 100 μm.

Therefore, the islands (or the dispersed discontinuous phase) can remarkably improve the silencing properties without lowering good mechanical properties and chemical properties of the first polymer.

On the other hand, an excess amount of discontinuous phase, for example, an addition of an excess mount of fluorine-containing polymer provides a larger size of discontinuous phases which act like continuous phase, and lowers mechanical properties of the first polymer, and it is not preferable to use an excess amount of discontinuous polymer.

In another embodiment, the present invention provides a fastener having a high silencing property comprising a base portion, a stem portion implanted and interconnected to the base portion in a spaced-apart relationship by a predetermined distance from the base portion, and a head portion interconnected to the distal end of the base portion, wherein the flexural elastic modulus of the fastener is increased so as to reduce a relative moving distance with respect to a relative moving operation of the engaged face fastener.

A preferred means for improving the flexural elastic modulus is to cause at least a part of the stem portion or the head portion to contain an amorphous polyamide resin as the first polymer resin.

The present invention also provides an engaged face fastener and a method of producing a fastener.

The fastener of the invention is typically engaged to another fastener in a face-to-face manner. However, the fastener may be engaged to a wide variety of components such as a hook-type material, a nonwoven fabric, a predrilled metal or plastic plate, etc.

DETAILED DESCRIPTION

Fasteners comprising a base portion, a stem portion implanted and interconnected to the base portion in a spaced-apart relationship by a predetermined distance from the base portion, and a head portion interconnected to the distal end of the base portion, and a production method thereof, are disclosed in U.S. Pat. Nos. 5,242,646, 4,290,832, 5,077,870 and 4,894,060 for example, and the shape and structure of the fastener and the production method thereof according to the present invention may be the same as those disclosed in these U.S. Pat. Nos. and other known references.

The characterizing feature of the present invention primarily resides in the material composition of the fastener. As used herein, the term "first polymer resin" represents the resin which constitutes the fastener and imparts a mechanical strength to the fastener. According to the first aspect of the present invention, the silencing property can be improved by blending either a fluorocarbon resin or a ultra-high molecular weight polyethylene resin to this first polymer resin. According to the second aspect of the present invention, the silencing property can be improved by the appropriate selection of the first polymer resin itself.

Examples of the first polymer resin used in the first embodiment of the present invention include a polyamide resin, a polypropylene resin, an ionomer resin, a urethane resin and an acrylic resin. Particularly preferred among them are thermoplastic resins such as the polyamide resin and the polypropylene resin because they provide a high mechanical strength, high durability and easy moldability. The term "polyamide resin" represents those polymers which are synthesized by the chemical reaction between organic acids and amide compounds, and generally denotes crystalline nylons such as 4,6-nylon, 6,6-nylon, 6-nylon, 6,10-nylon, 6,12-nylon, 11-nylon, 12-nylon, aromatic polyamides, etc.

According to the first embodiment of the present invention, offensive noise can be suppressed by dispersing and/or blending a phase comprising a second polymer resin with the first polymer resin. The second polymer resin comprises either a fluorocarbon polymer or an ultra-high molecular weight (UHMW) polyethylene. The resultant composition reduces the sliding resistance with respect to a relative moving operation of the fastener once it is engaged.

Fluorocarbon resins useful as the second polymer resin include a synthetic polymer containing a fluorine atom or atoms in the molecules thereof. Specific examples of the fluorocarbon resin include polytetrafluoroethylene (PTFE), fluorinated ethylene-propylene resin (FEP), fluorinated ethylene-perfluoroalkylvinylether copolymer resin (PFA), polychlorotrifluoroethylene (PCTFE), ethylene-tetrafluoroethylene copolymer resin (ETFE), polyvinylidene fluoride resin (PVDF), polyvinyl fluoride resin (PVF), and so forth. These resins are manufactured and marketed by Daikin Kogyo K.K., Mitsui-DuPont Fluorochemical K.K., etc., and are readily available commercially.

A resin comprising the first polymer resin and the fluorocarbon resin is commercially available. For example, PTEF (fluorocarbon resin)-containing polyamide resin is sold by Unitika (K.K.), and this product can be used as the material for the fastener of the present invention.

The ultra-high molecular weight polyethylene useful as the second polymer resin is a polyethylene having a mean molecular weight of at least 1,000,000, and is commercially available from Mitsui Petrochemical Co., Ltd.

The second polymer resin preferably has low fluidity. To mix these resins with the first polymer resin, the two resins are preferably kneaded and molded in advance into pellet using a biaxial extruder before they are used for injection molding. A sufficient permanent silencing effect can be obtained by adding 0.1 to 100 parts by weight of the second polymer resin per 100 parts by weight of the first polymer resin.

While more or less of the second polymer resin can be used, it has been found that if the amount of the second polymer resin is less than 0.1 part by weight, the continuous effect of improvement is low, and if it exceeds 100 parts by weight, on the other hand, the strength of the fastener remarkably drops, although the permanent silencing effect can be obtained.

The fastener is bonded in many cases to a to-be-bonded article such as a coated plate, through an adhesive tape. In such a case, the bonding strength between the back surface of the base portion of the fastener and the adhesive tape is very important, and the bonding strength with the adhesive tape drops when the amount of addition of the second polymer resin exceeds 100 parts by weight. Further, the amount of the addition of the second polymer resin is preferably from 50 to 40 parts by weight, and more preferably, from 10 to 25 parts by weight per 100 parts by weight of the first polymer resin.

According to the second aspect of the present invention, offensive noise can be suppressed by increasing the flexural modulus of the fastener. This reduces the distance the fastener can move when it is vibrated. It has been found that an amorphous polyamide resin may be used as the first polymer resin to increase the flexural modulus.

The term "amorphous polyamide resin" means those polyamide resins which are obtained by the chemical reaction between diamine compounds such as hexamethylenediamine and bis(4-amino-cyclohexyl)-methane derivatives and unsaturated carboxylic acids such as isophthalic acid and terephthalic acid, and a polyamide resin Cx2500 of a Unitika K.K. and #330 of DuPont correspond to this resin.

In these amorphous polyamide resins, the drop of mechanical properties due to water absorption, which is observed in 6-nylon and 6,6-nylon, is less, and they are relatively stable. This makes it possible to maintain a high flexural elastic modulus which is essentially necessary to prevent the creaking sound at the time of sliding.

The amorphous polyamide resin is preferred as the first polymer resin of the fastener of the present invention in order to improve the silencing property. A thermoplastic elastomer may be blended with this amorphous polyamide resin. This provides an elastomer phase having high stress absorptive power which is discontinuously dispersed in the amorphous polyamide phase. As a result, brittleness of the amorphous polyamide resin can be improved remarkably, durability of the fastener can be improved and eventually, the silencing effect can be maintained for a long period. From these aspects, the thermoplastic elastomer is preferably blended.

The thermoplastic elastomer useful in the invention has relatively lower fluidity than the amorphous polyamide resin. Therefore, to blend the thermoplastic elastomer to the amorphous polyamide resin, the two materials are preferably kneaded and molded in advance into a pellet form using a biaxial extruder, etc., when they are used in an injection molding machine.

From the aspect of injection moldability, a thermoplastic elastomer having a melt index of 0.1 to 50 at 230° C. (in accordance with ASTMD-123B, 2,160 g-load) is preferably used. If the melt index is less than 0.1, a fastener having a very fine structure cannot be produced easily because the resin has low fluidity inside the injection mold. If the melt index exceeds 50, the mean molecular weight becomes relatively so low that high toughness of the amorphous polyamide is impeded.

Further, the flexural elastic modulus of the thermoplastic elastomer is suitably from 100 to 20,000 kgf/cm$^2$. If the flexural elastic modulus is less than 100 kgf/cm$^2$, the mean molecular weight is relatively so low that the heat-resistance of the polyphase thermoplastic composition drops. If the flexural elastic modulus is greater than 20,000 kgf/cm$^2$, on the other hand, the elastic effect of the elastomer phase becomes low.

Further preferably, the thermoplastic elastomer described above may be modified by an acid anhydride or a functional group such as an epoxy group, a chlorine group, a carboxyl group, etc., or has an ester structure, an ether structure or a urethane bond or an amino bond. For, the elastomer phase can absorb the external stress which is applied at the time of sliding, by reinforcing the interface between the polyamide phase and the elastomer phase.

Specific examples of such a modified thermoplastic elastomer useful in the invention include:

Olefin type elastomers such as;

1. ethylene/propylene copolymer and its maleic anhydride-modified copolymer 2. ethylene/ethyl acrylate/maleic anhydride copolymer 3. ethylene/acrylic acid copolymer

4. EPDM 5. ethylene/methyl methacrylate copolymer 6. ethylene/ethyl acrylate copolymer 7. ethylene/vinyl acetate copolymer 8. ethylene/glycidyl methacrylate copolymer 9. ethylene/glycidyl methacrylate/vinyl acetate copolymer 10. ethylene/glycidyl methacrylate/vinyl acetate/methyl acrylate copolymer Urethane type elastomers such as;

1. urethane elastomer 2. urethane/vinyl chloride type copolymer

Polyester type elastomers;

Chlorinated type elastomers such as;

1. vinyl chloride

Acrylic type elastomers;

Styrene type elastomers such as;

1. styrene/ethylene/butylene/styrene block copolymer (SEBS) and its carboxyl-modified copolymer (SEBS)

2. styrene/ethylene/butylene/styrene/acrylonitrile block copolymer and its carboxyl-modified copolymer 3. styrene/butadiene/styrene block copolymer 4. styrene/isoprene/styrene block copolymer Fluoro-type elastomers such as;

1. vinylidene fluoride type elastomers 2. ethylene fluoride type elastomers

Specific examples of such modified thermoplastic elastomers include maleic anhydride-modified ethylene/propylene elastomer T-7712SP manufactured by Nippon Gosei Gomu K.K., ethylene/glycidyl methacrylate copolymer "Bond Fast 20B" manufactured by Sumitomo Kagaku K.K. and carboxyl-modified SEBS copolymer "Toughtec M1943" manufactured by Asahi Kasei K.K.

The thermoplastic elastomer can be added in an amount within the range of 1 to 150 parts by weight per 100 parts by weight of the first polymer resin. When the amount of the elastomer exceeds 150 parts by weight, the elastomer phase dispersed in the continuous phase of the amorphous polyamide resin becomes continuous, so that the creak sound at the time of sliding cannot be prevented. If the amount is less than 1 part by weight, the effect of improvement is low. Further, a preferred range of the amount of addition of the thermoplastic elastomer is from 10 to 70 parts by weight.

In yet another embodiment of the invention, a mixture of a crystalline polyamide resin and the amorphous polyamide resin can be used so as to improve toughness and compatibility of the amorphous polyamide to the thermoplastic elastomer and to reduce the cost, and in the aspect of good balance of flexibility.

The mixing ratio of the crystalline polyamide resin and the amorphous polyamide resin is preferably such that the crystalline polyamide resin accounts for 1 to 150 parts by weight on the basis of 100 parts by weight of the amorphous polyamide resin.

The crystalline polyamide resin has higher compatibility than the amorphous polyamide resin, and is free from the drop of mechanical properties. However, when the amount of the crystalline polyamide exceeds 150 parts by weight, the flexural elastic modulus will be remarkably reduced due to the increase of water absorbing power as one of the properties of the crystalline polyamide resin added to the amorphous polyamide resin. This makes it difficult to maintain a high flexural elastic modulus which is essentially necessary for preventing the creak sound at the time of sliding. In conjunction with the mixing ratio of the crystalline polyamide resin and the amorphous polyamide resin, the amount of the crystalline polyamide resin is preferably 5 to 100 parts by weight per 100 parts by weight of the amorphous polyamide resin and most preferably, from 10 to 90 parts by weight.

Examples of the crystalline polyamide resin to be used in the present invention are 4,6-nylon, 6,6-nylon, 6-nylon, 6,11-nylon, 6,12-nylon, and copolymer nylon (e.g. 6/66 copolymer nylon, 6/12 copolymer nylon). A more definite example is a 12-nylon under the trade name "30140" of Ube Industries.

Various other ingredients may be employed in the resin composition used to make the fastener of the invention. For example, a coloring may be used. Coloring agents are especially useful in detecting the presence of the core of the system remaining after a destructive disengagement of the fastener. Examples of coloring agents useful in the invention include inorganic pigments, organic pigments, and particularly red coloring agents such as red oxide, cadmium red, etc.; yellow coloring agents such as barium yellow, strontium yellow, etc.; blue coloring agents such as ultramarine blue, cobalt blue, phthalocyanine blue, etc.; green coloring agents such as chromium oxide, cobalt green, phthalocyanine green, etc.; and black coloring agent such as carbon black, graphite, etc.

A preferred fastener is black. This facilitates visual detection of the core for the stem after destructive disengagement because the remainder is white, particularly when the remainder comprises a polyphase of crystalline polyamide and amorphous polyamide resins.

In addition, the case where the fastener was made black by the use of carbon black, the following advantages were observed:

a. A small mount of black carbon provides a remarkable black-coloring effect.

b. The carbon black increases elastic modulus of a fastener, improves the silencing property, and makes control of mechanical strength easy. In addition, even in the case where silicon resin or ultra high molecular weight polyethylene resin is added to reduce a sliding resistance, a predetermined elastic modulus of the fastener is maintained and there is no fear of decreasing handwearing properties and mechanical strength.

c. When the present article is molded, a certain amount of waste resin material is provided. To reduce a cost, such waste is mixed by stirring with fresh resin material to reuse. In this case the carbon black smoothes the mixing.

d. By including a predetermined amount of carbon black, a fastener becomes electrically conductive.

Note that as carbon black, thermal black, acetylene black, channel black, furnace black, etc., can be used. More specifically, Carbon Black Asahi #51, 15, Asahi Thermal, manufactured by Asahi Carbon; Carbon Black #2400B, #1000, MA8, #40, etc., manufactured by Mitsubishi Chemical, and the like can be used. The shape of the carbon black may be globule or fiber, though chain shape comprising a plurality of particles linked each other is also preferable because it provides electric conductivity increasing effect.

Primary average particle size of these carbon blacks are preferably 10 to 150 nm. Where the size is smaller than 10 nm, mixing and dispersion is not difficult, while the particle size is larger than 150 nm, coloring power is remarkably decreased. Accordingly, coloring power of carbon black suitable for the present invention is at least 50%, and more preferably at least 100%. It is because black-coloring is possible by a smaller amount of carbon black.

Note, the primary average particle size is measured by electromicrocopy, and coloring power is measured according to JIS K6221.

On the other hand, where graphite is used as a coloring agent for black-coloring, there are advantages in that a small amount of graphite added provides lubricating effect, high silencing effect and electrical conductance.

As a coloring agent of the present invention, graphite-coated carbon black is most preferable. A small amount of addition provides coloring effect, and an adequate level of lubrication effect. Examples of these coloring agents are products of tradenames #4010, #4040, manufactured by Mitsubishi Chemical: a product of tradename spheron 6, stering R, manufactured by CABOT; and the like.

Next, an amount of a coloring agent added in the present invention is 0.1 to 100 parts by weight relative to 100 parts by weight of high molecular weight resin material. An addition of less than 0.1parts by weight provides a poor black-coloring effect, while an amount of more than 100 parts by weight makes dispersion and mixing difficult, necessitates the use of high temperature of a molding operation and a mold, and surface lubrication is lost.

In addition, a range of more preferable amount of a coloring agent is 0.5 to 50 parts by weight, and most preferably 1.0 to 30 parts by weight. In such a range, there is little fear that the coloring agent effects on flowability of ultra-high molecular weight resin during molding.

Other ingredients may also be used in the present invention. They include paraffin wax and higher fatty acids such as palmitic acid, stearic acid, oleic acid, etc. Additionally, a small amount of calcium stearate, fatty acid esters, mineral oil, silicone oil, or the like, may also be added to the resin composition used to make the fastener. These additive components provide an auxiliary silencing effect. The amount of these additives used is 0.01 to 5 parts by weight and more preferably, 0.1 to 3 parts by weight, per 100 parts by weight of the resin. If the amount is outside the range of 0.01 to 5 parts by weight, the auxiliary improvement effect is low, or tape bondability will drop.

The above-mentioned resin composition is also preferably used for modifying fastener, for example those having so-called clips, hooks or bosses under the base portion to facilitate attachment of the fastener to a substrate.

The above-mentioned resin compositions are preferable for, not only fastener, but also clip, hook or boss not having fastener, because sliding resistance reduced.

Next, a production method of the fastener will be explained. More definitely, the fastener can be produced by the following method.

Production method 1

The detail is described in U.S. Pat. No. 5,242,646, and this method includes the following steps:

a. the step of preparing a mold having a cavity for the base portion of the fastener;

b. the step of preparing a core for the stem portion, capable of being removed non-destructively;

c. the step of preparing a mold having a cavity for the heat portion of the fastener;

d. the step of producing a molten resin into the mold to produce the fastener; and e. the step of releasing the fastener equipped with the core for the stem portion from the mold, and non-destructively removing the core for the stem portion.

The advantage of this method is that a fastener having a complicated shape can be produced economically with high accuracy.

Production method 2

The detail is described in U.S. Pat. No. 4,290,174, and the method includes the following steps:

a. the step of so arranging two sheets for the base portion as to face each other with a predetermined gap, and feeding them in the same direction;

b. the step of alternately implanting mono-filaments by a striker to the sheets heated and molten;

c. the step of cutting the monofilaments at an intermediate portion of the predetermined gap of the sheets; and d. the step of heating and melting a part of the monofilaments and shaping the head portion.

The advantage of this method is that a wound article of a fastener is available, and the product can be economically produced with high production efficiency.

Production method 3

The detail is described in U.S. Pat. No. 5,077,870, and the method comprises the following steps.

a. the step of rotating in an axial direction a mold having therein a cavity having a hole for inserting a molten resin, the hole corresponding to the stem portion of the engaged face fastener;

b. the step of sucking air in an inside direction of the mold;

c. the step of carrying out injection molding of the molten resin to the surface of the mold; and d. the step of peeling a molded resin from the mold and heating it to mold the head portion.

This method has the advantage that a wound article of a fastener is available, and the product can be produced economically with high production efficiency.

Production method 4

The detail is described in U.S. Pat. No. 4,894,060, and the method comprises the following steps:

a. the step of extruding a molten resin by a resin extruder and molding a rail-like article comprising the base portion, and the stem portion and the head portion spaced apart by a predetermined gap in only a direction extending straight to the extruding direction;

b. the step of forming cut-in portions in the rail-like article in a direction at about 90° with respect to the extruding direction with predetermined gaps between them; and c. the step of heating and stretching the base portion, and separating the stem portions of the fasteners adjacent to one another, in the extruding direction.

This method has the advantage that a fastener having a higher strength can be economically produced.

EXAMPLES

Hereinafter, the present invention will be explained in further detail with reference to Examples thereof.

In the following Examples, the standard shape face fasteners of Sumitomo 3M Co., Ltd. were produced using an injection molding machine PS-40 manufactured by Nissei Resin Industries Co., Ltd., and the following evaluations were carried out.

1. Noise test

Two fasteners were bonded to separate stainless steel sheets through a primer C-100 and an acrylic foam tape #4215 manufactured by Sumitomo 3M Co., Ltd., respectively, and were then engaged with each other in a cross direction. Next, while one of the stainless steel sheets was kept fixed, the other was vibrated at an amplitude of 0.5 mm or 1.0 mm and a frequency of 12 Hz using a vibrator (a micro-shaker MEE-035 manufactured by Akashi K.K.) equipped with a displacement meter (a laser displacement meter LD-2500 manufactured by Keyence Co., Ltd.) so as to measure the occurrence of noise.

The evaluation OK represents the case where no offensive noise occurred, and NG does the case where it occurred.

2. Water absorption test

The water absorption test was carried out in accordance with ASTM D570, by immersing each testpiece in water at 23° C. for 24 hours. The scores "excellent", "fair" and "not good" present the water absorption ratios of below 0.5%, from 0.5 to 2.0% and higher than 2.0%, respectively.

3. Change ratio

After each testpiece was immersed in water at room temperature for 48 hours, its flexural elastic modulus and flexural elastic modulus at absolute dryness were measured in accordance with ASTM D790, and the change ratio was determined in accordance with the following formula:

change ratio=(flexural elastic modulus after immersion)/(flexural elastic modulus at absolute dryness) Equation 1

The change ratio of not lower than 0.5 was evaluated as OK and the change ratio of less than 0.5%, as NG.

Symbols representing the materials used in the following Examples represent the following compounds, respectively:

TABLE 1

| | |
|---|---|
| A1030TF: | PTFE-containing 6-nylon, product of Unitika Co., Ltd. |
| A125TF: | PTFE-containing 66-nylon, product of Unitika Co., Ltd. |
| A1030M: | molybdenum disulfide-containing 6-nylon, product of Unitika Co., Ltd. |
| A125 - T5959: | silicone oil-containing 6,6-nylon, product of Unitika Co., Ltd. |
| Ex1030: | acid modified rubber-containing 6-nylon, product of Unitika Co., Ltd. |
| Cx2500: | amorphous nylon, product of Unitika Co., Ltd. |
| T7712SP: | maleic anhydride-modified ethylenepropylene rubber |
| 3014U: | 12-nylon, product of Ube Industries, Co., Ltd. |
| 1200S: | 6,6-nylon, product of Asahi Chemical Industry Co., Ltd. |
| 1011CH5: | 6-nylon, product of Mitsubishi Chemical Industry Co., Ltd. |

TABLE 1-continued

| | |
|---|---|
| BF20B: | epoxy-modified polyethylene copolymer, product of Sumitomo Chemical Ind. Co., Ltd. |
| M7686: | polypropylene, product of Asahi Chemical Ind. Co., Ltd. |
| UHMW: | ultra-high molecular weight polyethylene, product of Mitsui Petrochemical Co., Ltd. |
| PTFE: | polytetrafluoroethylene, product of Wako Pure Chemical Co., Ltd. |
| stearic acid: | stearic acid, product of Wako Pure Chemical Co., Ltd. |
| carbon: | "Asahi Thermal", product of Asahi Carbon Co., Ltd. |
| #4215: | acrylic foam tape, product of Sumitomo 3M Co., Ltd. |
| C-100: | primer, product of Sumitomo 3M Co., Ltd. |
| P delryn 500: | polyacetal resin, product of E.I. DuPont Co., Ltd. |
| M1943: | carboxyl-modified SEBS, product of Asahi Chemical Industry Co., Ltd. |

Examples 1 to 6

Fasteners were produced from the compositions of the first embodiments of the present invention, and were evaluated, respectively. Table 2 tabulates ratios of the materials used, the proportion of each component in the composition, and the evaluation results.

TABLE 2

| | Example 1 | Example 2 | Example 3 | Example 4 | Example 5 | Example 6 |
|---|---|---|---|---|---|---|
| Materials (weight ratio) | A125TF (100) | 1200S (99) PTFE (1) stearic acid (0.2) | M7686 (60) UHMW (40) carbon (0.6) | A1030TF (100) | 3014U (96) PTFE (4) | A125TF (67) PTFE (33) |
| Components (weight ratio) | | | | | | |
| main polymer resin | PA (100) | PA (100) | PP (100) | PA (100) | PA (100) | PA (100) |
| second component | PTFE (33) | PTFE (1) | UP (67) | PTFE (11) | PTFE (4) | PTFE (50) |
| Evaluation | | | | | | |
| water absorption change ratio | fair OK | fair OK | excellent OK | fair OK | fair OK | excellent OK |
| noise | | | | | | |
| 0.5 mm | OK | OK | OK | OK | OK | OK |
| 1.0 mm | OK | OK | OK | OK | OK | OK |

NOTE:
PA: polyamide resin, PP: polypropylene resin
PTFE: polytetrafluoroethylene resin
UP: Ultra-high density polyethylene resin
UHMW: Ultra-high molecular weight polyethylene resin

Examples 7 to 13

Fasteners were produced from the compositions of the second embodiments of the present invention, and were evaluated, respectively. Table 3 tabulates ratios of the materials used, the proportion of each component in the composition, and the evaluation results.

TABLE 3

| | Example 7 | Example 8 | Example 9 | Example 10 | Example 11 | Example 12 | Example 13 |
|---|---|---|---|---|---|---|---|
| Materials (weight ratio) | Cx2500 (98)<br>T7712SP (2) | Cx2500 (80)<br>T7712SP (10)<br>3014U (10) | Cx2500 (54)<br>Ex1030 (45)<br>carbon (0.8)<br>stearic acid (0.2) | Cx2500 (70)<br>BF20B (30) | Cx2500 (62)<br>BF20B (38) | #330 | Cx2500 (45)<br>3014U (32)<br>M1943 (20) |
| Components (weight ratio) | | | | | | | |
| amorphous polyamide | (100) | (100) | (100) | (100) | (100) | (100) | (100) |
| elastomer | EP (2) | EP (15) | EP (29) | EPOXY-EP (50) | EPOXY-EP (71) | | C-SEBS (48) |
| crystalline polyamide | PA (16) | PA (31) | PA (84) | PA (16) | PA (16) | | PA (94) |
| Evaluation | | | | | | | |
| change ratio | Excellent | Excellent | Fair | Excellent | Excellent | Excellent | Excellent |
| water absorption | OK | OK | OK | OK | OK | OK | OK |
| noise | | | | | | | |
| 0.5 mm | OK | OK | OK | OK | OK | OK | OK |
| 1.0 mm | OK | OK | OK | OK | OK | OK | OK |

NOTE:
EP: ethylene/propylene copolymer,
EPOXY-EP: epoxy-modified ethylene copolymer,
C-SEBS: carboxyl-modified SEBS Cl-ure: vinyl chloride/urethane copolymer,
PA: polyamide resin

Comparative Examples 1 to 5

Fasteners were produced from the compositions not belonging to the present invention, and were evaluated, respectively. The results are tabulated in Table 4.

TABLE 4

| | Comp. Ex. 1 | Comp. Ex. 2 | Comp. Ex. 3 | Comp. Ex. 4 | Comp. Ex. 5 |
|---|---|---|---|---|---|
| Materials (weight ratio) | 1011CH5 (100) | M7686 (100) | P-delryn 500 (100) | A125 – T5959 (100) | A1030M (100) |
| Components (weight ratio) | | | | | |
| main polymer resin | PA (100) | PP (100) | Pac (100) | PA (100) | PA (100) |
| other components | — | — | — | silicone oil (3) | cured molybdenum (3) |
| Evaluation | | | | | |
| water absorption | not good | Excellent | Excellent | not good | not good |
| change ratio | NG | OK | OK | NG | NG |
| noise | | | | | |
| 0.5 mm | NG | NG | NG | NG | NG |
| 1.0 mm | NG | NG | NG | NG | NG |

NOTE:
PA: polyamide resin
PP: polypropylene resin
Pac: polyacetal resin

Effect of the Invention

As described above, the fastener according to the present invention does not generate the noise when any vibration is applied thereto. For this reason, it is particularly effective as a fastener member for fitting automobile components.

We claim:

1. A fastener having a high silencing property comprising a base portion, a stem portion implanted and interconnected to said base portion and a head portion interconnected to said stem portion in a spaced-apart relationship by a predetermined distance from said base portion, wherein at least a part of said stem portion or said head portion contains polyphase polymer materials comprising a first polymer resin selected from the group consisting of polyamide resin, polypropylene resin, ionomer resin, urethane resin, and acrylic resin, and a second polymer resin containing a fluorocarbon resin or a ultra-high molecular weight polyethylene resin.

2. A fastener having a high silencing property according to claim 1, wherein the article to be engaged is another fastener which engages with the claimed in a fastener face-to-face manner.

3. A fastener having a high silencing property according to claim 1 wherein 0.1 to 100 parts by weight of said fluorocarbon resin or said ultra-high molecular weight polyethylene resin is added to 100 parts by weight of said first polymer resin.

4. A fastener having a high silencing property comprising a base portion, a stem portion implanted and interconnected to said base portion and a head portion interconnected to said stem portion in a spaced-apart relationship by a predetermined distance from said base portion, wherein at least a part of said stem portion or said head portion contains an amorphous polyamide resin as a first polymer resin.

5. A fastener having a high silencing property according to claim 4 wherein the first polymer resin comprises a mixed resin of amorphous polyamide resin and crystalline polyamide resin, and the ratio of the resins is 1 to 150 parts by weight of said crystalline polyamide resin per 100 parts by weight of said amorphous polyamide resin.

6. A fastener having a high silencing property according to claim 4 or 5 wherein 1 to 150 parts by weight of a thermoplastic elastomer is added to 100 parts by weight of said first polymer resin.

7. A fastener having a high silencing property according to claim 6 wherein said thermoplastic elastomer contains at least one member selected from the group consisting of an epoxy group, a carboxyl group, an acid anhydride, an ester bond, an ether bond, a urethane bond, an amino group and a halogen.

8. A fastener having a high silencing property according to claims 1 or 4 wherein the fastener has a polyphase structure comprising at least two polymers wherein at least one polymer forms a continuous phase and at least one another polymer forms discontinuous phase.

9. A fastener having a high silencing property according to claim 8 wherein the size of the discontinuous phase is 0.01 to 100 μm.

10. A fastener having high silencing property according to any one of claims 1 or 4 characterized in that the fastener contains a coloring agent.

11. A fastener comprising a base portion, a stem portion connected to said base portion and a head portion interconnected to said stem portion in a spaced-apart relationship from said base portion wherein said stem portion or said head portion comprises a polymer resin system selected from the group consisting of a first polymer resin comprising an amorphous polyamide resin and a polyphase resin system comprising a first continuous phase and a second discontinuous phase.

12. A fastener according to claim 11 wherein a thermoplastic elastomer is dispersed in said amorphous polyamide resin.

13. A fastener according to claim 12 wherein said thermoplastic elastomer comprises from 1 to 150 parts by weight per 100 parts by weight of said amorphous polyamide resin.

14. A fastener according to claim 11 or claim 12 wherein a crystalline polyamide resin is combined with said amorphous polyamide resin.

15. A fastener according to claim 14 wherein said crystalline polyamide resin comprises from 1 to 150 parts by weight per 100 parts by weight of said amorphous polyamide resin.

16. A fastener system according to claim 11 wherein said first continuous phase is a material selected from the group consisting of polyamide resin, polypropylene resin, ionomer resin and acrylic resin and said discontinuous phase is a material selected from the group consisting of a fluorocarbon polymer and an ultra-high molecular weight polyethylene.

17. A fastener system according to claim 16 wherein the material of said discontinuous phase comprises from 0.1 to 100 parts by weight per 100 parts by weight of the material of said continuous phase.

18. A method of producing a fastener having a high silencing property according to claims 1, 4, or 11 comprising the steps of:

a. the step of preparing a mold having a space for said base portion of said fastener;

b. the step of preparing a core for said stem portion, capable of being non-destructively removed;

c. the step of preparing a mold having a space for said head portion of said fastener;

d. the step of pouring a molten resin into said mold to produce said fastener; and e. the step of releasing said fastener equipped with said core for said stem portion from said mold, and non-destructively removing said core for said stem portion.

19. A method of producing a fastener having a high silencing property according to any of claims 1, 4 or 11 comprising the steps of:

a. the step of so arranging two sheets for said base portion as to face each other with a predetermined gap, and feeding them in the same direction;

b. the step of alternately implanting monofilaments by a striker to said sheets heated and molten;

c. the step of cutting said monofilaments at an intermediate portion of said predetermined gap of said sheets; and d. the step of heating and melting a part of said monofilament and shaping said head portion.

20. A method of producing a fastener having a high silencing property according to any of claims 1, 4 or 11 comprising the steps of:

a. the step of rotating in an axial direction a mold having therein a cavity having a hole for inserting a molten resin, said hole corresponding to said stem portion of said fastener;

b. the step of sucking air in an inside direction of said mold;

c. the step of carrying out injection molding of said molten resin to the surface of said mold; and d. the step of peeling a molded resin from said mold and heating it to mold said head portion.

21. A method of producing a fastener having a high silencing property according to any of claims 1, 4 or 11 comprising the steps of:

a. the step of extruding a molten resin by a resin extruder and molding a rail-like article comprising said base portion, and said stem portion and said head portion spaced apart by a predetermined gap in only a direction extending straight to the extruding direction;

b. the step of forming cut-in portions in said rail-like article in a direction at about 90° with respect to the extruding direction with predetermined gaps between them; and c. the step of heating and stretching said base portion, and separating said stem portions of said fasteners adjacent to one another, in the extruding direction.

* * * * *